US005256124A

United States Patent [19]

Hughes

[11] Patent Number: 5,256,124

[45] Date of Patent: Oct. 26, 1993

[54] BODY EXERCISER USING DISTRIBUTED FRICTIONAL BRAKE MEANS AND CENTRAL ACTING BIASING MEANS

[76] Inventor: Paul G. Hughes, 1725 Caulfield La., Petaluma, Calif. 94954

[21] Appl. No.: 933,340

[22] Filed: Aug. 21, 1992

Related U.S. Application Data

[63] Continuation-in-part of Ser. No. 668,591, Mar. 13, 1991, Pat. No. 5,158,519.

[51] Int. Cl.[5] ..... A63B 21/015

[52] U.S. Cl. ..... 482/118

[58] Field of Search ..... 482/114, 115, 118, 116, 482/117, 119; 128/25 R

[56] References Cited

U.S. PATENT DOCUMENTS

| | | | |
|---|---|---|---|
| Re. 23,744 | 11/1953 | Magida | 482/118 |
| 3,640,525 | 2/1972 | Proctor | 482/115 |
| 4,684,126 | 8/1987 | Dalebout et al. | 482/118 |
| 4,822,028 | 4/1989 | McLellan et al. | 482/114 |
| 4,869,492 | 9/1989 | Joutras | 482/118 |
| 5,158,519 | 10/1992 | Hughes | 482/118 |

*Primary Examiner*—Stephen R. Crow
*Attorney, Agent, or Firm*—Harold D. Messner

[57] ABSTRACT

An exercisor is described comprising two cranks journaled from opposite directions into a pair of independently operating friction brakes within a central housing. However, while the friction brakes of each crank are independently operatable via a crank arm, they are interconnected by a common friction biasing mechanism. Such mechanism is also housed within the central housing between the friction brakes. The friction biasing mechanism includes a wedge block having slanted side surfaces in contact push blocks of the friction brakes. The wedge block is provided with transverse movement relative to the central housing by rotation of an activation rod (by the user), such rod having an axis of rotation that is normal to the axis of symmetry of the central housing. Such transverse movement, in turn, is converted to bi-directional travel of the push blocks toward the ends of the central housing where the cranks are positioned. As a result, there is generated within each friction brake a bi-directional pressure that resists rotation of the crank operatively attached to the friction brake in an uniform manner.

20 Claims, 5 Drawing Sheets

BODY EXERCISER USING DISTRIBUTED FRICTIONAL BRAKE MEANS AND CENTRAL ACTING BIASING MEANS

RELATED APPLICATION

This application is a continuation-in-part of the following application Ser. No. 07/668,591 filed Mar. 13, 1991 for "BODY EXERCISER USING MULTI-SURFACED, DISTRIBUTED FRICTIONAL BRAKE MEANS" now U.S. Pat. No. 5,158,519 issued Oct. 22, 1992

In the parent application, two cranks are journaled from opposite directions into independently operating friction brakes, all operationally secured within a central housing. The friction brakes of each crank are adjusted as to friction bias, by a common frictional biasing means that includes an activation rod that extends exterior of the housing. But since the rod is disposed coaxial of the axes of rotation of the assembly, it must extend through the hub of one of the crank. In addition, in such position, the rod can be fitted with a handle which is positioned adjacent to the plane of rotation of the crank handle. In such position, the rod handle has been found to sometimes interfere with the user's arms as the cranks are worked.

SCOPE OF THE INVENTION

The present invention relates to body exercisers and more particularly to methods and means for exercising large muscles of a person in tandem or independently using such exercisers wherein resistance to movement of separately liftable and retractable cranks of such exercisers is provided by independently operating friction brakes interconnected by a centrally positioned friction biasing means. In one aspect, biasing pressure for the frictional brakes is provided by a bi-directionally acting, calibrating angled wedge block connected to an activating rod having an axis of rotation perpendicular to the axes of rotation of the cranks, such rod having a handle that extends exteriorly of the central housing midway between but in non-interfering contact with the operation of the cranks.

BACKGROUND OF THE INVENTION

In my application referenced above, two cranks are journaled from opposite directions into independently operating friction brakes, all operationally secured within a central housing. The friction brakes of each crank are adjusted as to friction bias, by a common frictional biasing means that includes an activation rod that extends exterior of the housing. But since the rod is disposed coaxial of the axes of rotation of the assembly, it must extend through the hub of one of the crank. In addition, in such extension position, the rod can be fitted with a handle which is positioned adjacent to the plane of rotation of the crank handle. In such position, the rod handle has been found to sometimes interfere with one of the user's arms as the cranks are worked.

SUMMARY OF THE INVENTION

In accordance with the invention, an exerciser is described which comprises a simple structure composed of a paucity of elements which can be readily assembled while at the same time can generate a surprisingly large, distributed resistance load (say up to 350 pounds at conventional lifting lengths) without using pulley-or cable-pressure whereby the user's limbs can be worked in both push-pull, pull only or push only replications. The exerciser comprises essentially two cranks journaled from opposite directions into independently operating friction brakes for like-independent operation of the cranks by the user. The friction brakes of each crank—while independently operatable—are interconnected by a central located friction biasing means housed within a horizontally extending, central housing. The biasing means includes an activation rod. The rod has a handle that extends exterior of the housing midway between the cranks. The biasing means generates biasing pressure via a centrally disposed wedge block attached to the rod. The wedge block includes slanted, opposed side surfaces. They contact opposed slanted end surfaces of a pair of push blocks. In operation, transverse movement of the wedge block (in response to rotation of the rod) normal to the longitudinal axis of symmetry of the central housing, causes longitudinal wedging movement of the push blocks against the stationary and rotational members of the friction brakes relative to fixed end blocks of the housing. Since each friction brake also includes a series of stackable, laterally slidable rotatable and stationary members, such squeezing pressure brings all broad vertical surfaces of these members into frictional contact—sandwich style—with each other.

During the exercise session, the friction biasing means of the invention generates squeezing forces at the push block in a rapid manner since transverse, rectilinear movement of the wedge block is multiplied by a factor of two at the oppositely slanted end surfaces of the push blocks. Source of such bi-directional movement is the opposite angled working surfaces of the wedge block against the end surfaces of the push blocks. Furthermore, if the housing is slotted in the vicinity of the wedge block, the rectilinear movement of the latter can also be used as an indicator of magnitude of resistance loading. In order to aid in the indication process, resistance loading values are marked on an exteriorly viewable scale adjacent to the slot through which an indication pointer operatively attached to the wedge block is viewed.

From the preceding discussion, it is seen that the invention has as its objects, inter alia, the provision of an improved exerciser composed of few and simple elements which can be assembled easily at low cost but which has versatility wherein large resistance loads to movement via one or the other crank arms can be generated whereby the larger muscles of the user can be worked in both push-pull, pull only or push only replications. Other objects of the invention will become apparent from the following more detailed description and accompanying drawings in which:

PREFERRED DESCRIPTION OF AN EMBODIMENT OF THE INVENTION

Figure 1:
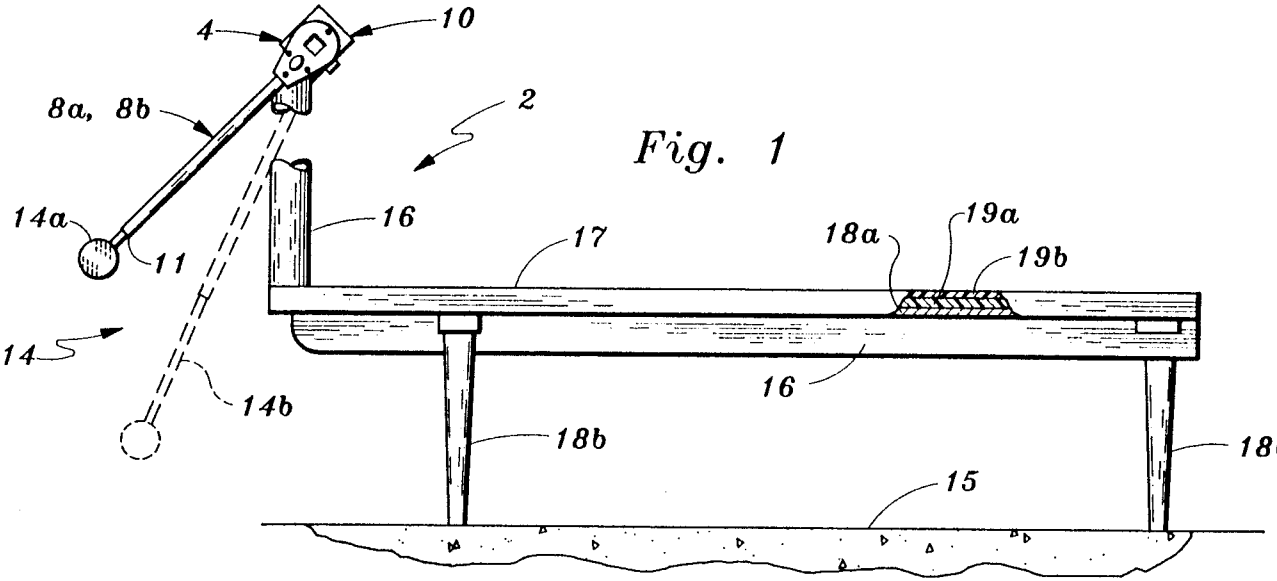
FIGS. 1 and 2 are side and front elevational views of the exerciser of the invention partially exploded to illustrate various handle configurations attachable to two cranks journaled from opposite directions into a central housing that is affixed to a permanent support structure, such as an exercise bench.
Figure 2:
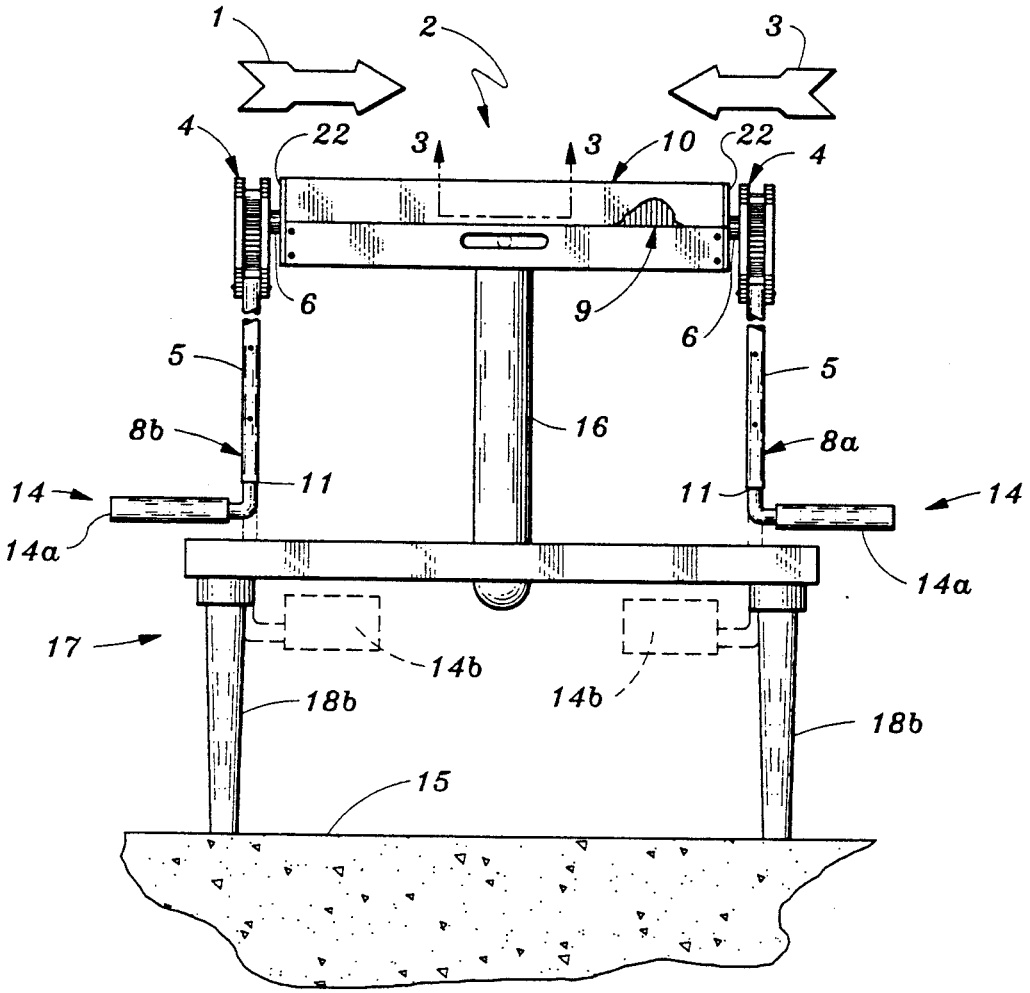

FIGS. 1 and 2 are side and front views of the exerciser 2 of the invention. The exerciser 2 comprises a simple structure composed of elements which can be readily assembled while at the same time can generate a large resistance load without using pulley- or cable-pressure. In that way the larger muscles of the user can be worked in both push-pull, pull only or push only replications.

In more detail, the exerciser 2 is comprised essentially of two cranks 8*a*, 8*b* and independently operating friction means 9 (see FIG. 2) housed within a central housing 10. Each crank 8*a*, 8*b* is L-shaped and comprises a forearm 5, a lateral arm 6 and ratcheting mechanism 4. The forearm 5 and lateral arm 6 are interconnected via the rachet mechanism 4. The forearm 5 includes an end 11 remote from the central housing 10 connectable to a series of action arms generally indicated at 14 to permit different muscles of the user to be worked. For example, (i) an L-shaped arm-handle 14*a* is shown and is used for arm lifts, arms curls and arm stretches above a floor 15 using a goose-necked attachment 16 attached to an exercise bench 17 composed of flat support 18*a*, legs 18*b*, plastic ticking 19*a* and cover 19*b* overlaying the support 18*a*, the attachment 16 extending over a portion of the horizontal extent of bench 17. Note in the embodiment of item (i) that handle 14*a*' is parallel to the floor 15 and is operated either over limited arcuate ranges, say 90 degrees or over a full 360 degree rotation; and (ii) a second embodiment in which leg brackets 14*b* (shown in FIGS. 1 and 2 in phantom line) are located below the exercise bench 17) and are operated over limited arcuate ranges for leg extensions and curls. However, it should be noted that a separate L-shaped arm-handle could be added to the above-disclosed embodiments without undue experimentation, e.g., adjacent to a seat of an automobile in which the handle is perpendicular to the floor to emulate a gear-shift lever of a race car.

A separate lateral arm 6 of each crank 8*a*, 8*b* has a major portion (not shown) positioned within the central housing 10, such portion extending therein from an opposite direction indicated by arrows 1, 3. The ends of the arms 6 are journaled interior of the friction braking means 9 within the central housing 10 as explained below.

Figure 3:
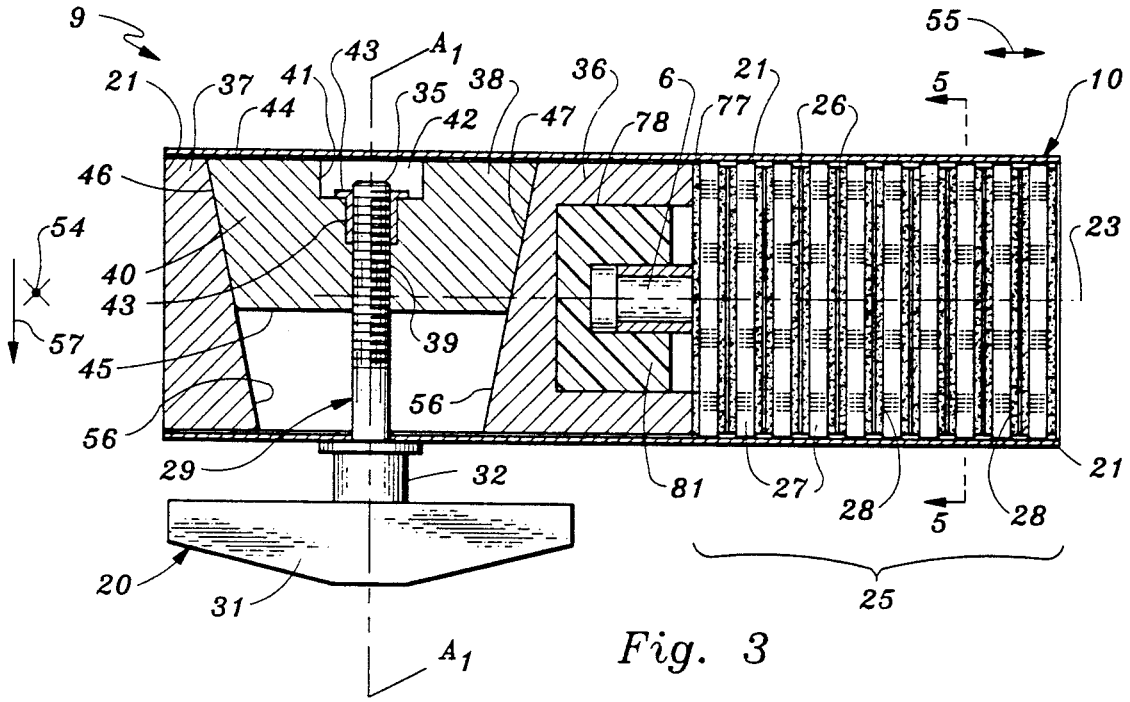
FIG. 3 is an enlarged section taken along line 3—3 of FIG. 2 to illustrate friction braking means and a friction biasing means in more detail, each braking means including a series of rotatable and stationary members having broad frictional contact, the rotatable members attached to and rotatable with the cranks about a common axis of rotation but having bi-directional biasing pressure applied thereto via the mid-located friction biasing means, the latter including a transversely movable wedge block attached to an activation rod having an axis of symmetry normal to the axes of rotation of the crank arms, the wedge block having oppositely sloped surfaces in sliding contact with oppositely slanted end surfaces of a pair of push blocks at the ends of the rotatable and stationary members of the braking means, such biasing pressure being provided by the transverse movement of the wedge block being translated into longitudinal movement of the push blocks against the braking members and thence against fixed end walls of the central housing.

FIG. 3 shows the friction braking means 9 in more detail.

As shown, the friction braking means 9 is housed interiorly of upright side walls 21 of central housing 10. Relative to either horizontal axis of symmetry 23 of the housing 10 or with regard to a vertical plane of action A1—A1 that bisects friction biasing means 20 of the invention, the side walls 21 are of square cross section. Thus, along the axis of symmetry 23, different sectioned elements of the braking means 9 can be given the capability of rotation about such axis 23 merely because of their shape relative to that of the lateral arm 6.

For example, the braking means 9 includes a first group of members generally indicated at 25 offset in the longitudinal direction relative to the action plane A1—A1. (A second group of members identical to the first group 25 is offset from the action plane A1—A1 but is not shown in the interest of brevity since description of one suffices for the other.) The first and second groups are associated with independent movement of the lateral arms 6 about the axis of symmetry 23.

The group 25 includes a series of interiorly disposed rotatable members 26 and stationary members 27. In this regard, the group 25 is subdivided into sets, each set comprising a rotating member 26 and a pair of stationary members 27 in side-by-side sandwich contact along broad surfaces 28 parallel to the vertical plane of action A1—A1. Each set defines a finite length and together form a distributed loading so as to provide a distributed loading that smoothly resists the rotation of the arms 6. In this regard at least 6-10 separate sets are needed to act in concert relative to movement of each arm 6 while 7-9 sets per group are preferred. Of course, the function of broad contact between the members 26, 27 is to provide a smooth resistance to rotary movement of the lateral arms 6. In this regard, the stationary members 27 are covered with a material to provide smooth braking action and as previously mentioned, are positioned—sandwich style—about the rotatable members 26 to resist movement of the latter in concert with rotation of the lateral arms 6 about axis of symmetry 23.

Figure 5:
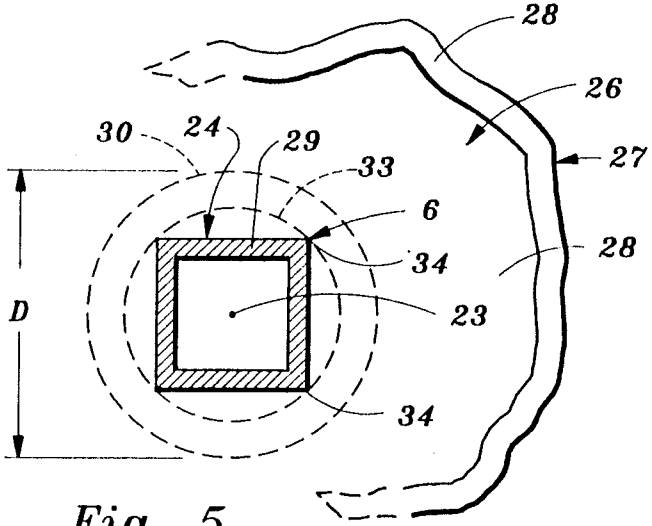
FIG. 5 is a detail end view of the crank arm exiting from one of the fixed end blocks of the central housing of FIG. 2.

Within each set, the rotating member 26 is operatively positioned about the lateral arm 6 in the manner shown in FIG. 5. As shown, the rotating member 26 is annularly shaped and includes a central opening 24 of square cross section defining an axis of symmetry coincident with axis of symmetry 23 of the housing. Because the central opening 24 of the rotating member 26 is constructed to have full edge contact with side wall 29 of the arm 6, the member 26 rotates in concert with lateral arm 6 about an axis of rotation coincident with the axis of symmetry 23.

Still referring to FIG. 5, the stationary members 27 each include a central opening 30 of circular cross section defining a diameter D having a center of formation coincident with the axis of symmetry 23. Note in this regard that central opening 30 is larger than imaginary circle 33 generated by the rotation of corners 34 of the lateral arm 6 about axis of symmetry 23. Each stationary member 27 also has a large transverse length that places such member 27 in direct contact with the central housing 10 as explained below. Note further that since the distribution of the sets of members 26, 27 must be such that the broad surfaces 28 of each are placed side-by-side sandwich contact with adjacent members, the members 26, 27 are formed into a single integrated unit operating in response to rotation of arm 6 about axis of symmetry 23.

Returning to FIG. 3, note that at the interior ends of the unitary combination of members 26, 27 described above are provided by a pair of push blocks 36, 37. And alternately, the exterior ends of such unitary combination of members 26, 27 are provided by end blocks 22 (see FIG. 2) attached to the central housing 10 by screws.

Returning to FIG. 3, changes in braking power are easily achieved via friction biasing means 20. It comprises a threaded rod 29 having an axis of rotation coincident with action plane A1—A1 and normal to the axis of symmetry 23 of the central housing 10, and generates simultaneous bi-directional movement of the member groups including group 25 relative to the vertical plane A1—A1. That is, the friction biasing means 20 permits longitudinal adjustment—in opposite directions—of push blocks 36, 37 relative to the end blocks 22 (see FIG. 2) fixed to the central housing 10. Since the push blocks 36, 37 are movable, they can bring members 26, 27 into squeezing contact with each other against the fixed end blocks 22.

In detail, note that threaded rod 29 attaches to a handle 31 that is also bisected by vertical action plane A1—A1. The handle 31 includes a hub 32 having a threaded cavity (not shown) into which rod 29 is threadably inserted. At its opposite end 35, the rod 29 extends through and into a central wedge block 38. The wedge block 38 includes a central cavity 39 having a side wall 40 that is slightly larger in diameter than that of the rod 29. At end wall 41, the side wall 40 is enlarged to form end cavity 42 into which nut 43 is fixedly placed. The nut 43 also has a threaded side wall to engage the threads of the rod 29. As shown, the wedge block 38 includes parallel top and bottom surfaces 44, 45 and non-parallel side walls 46, 47 slanted toward the handle 31.

Figure 16:
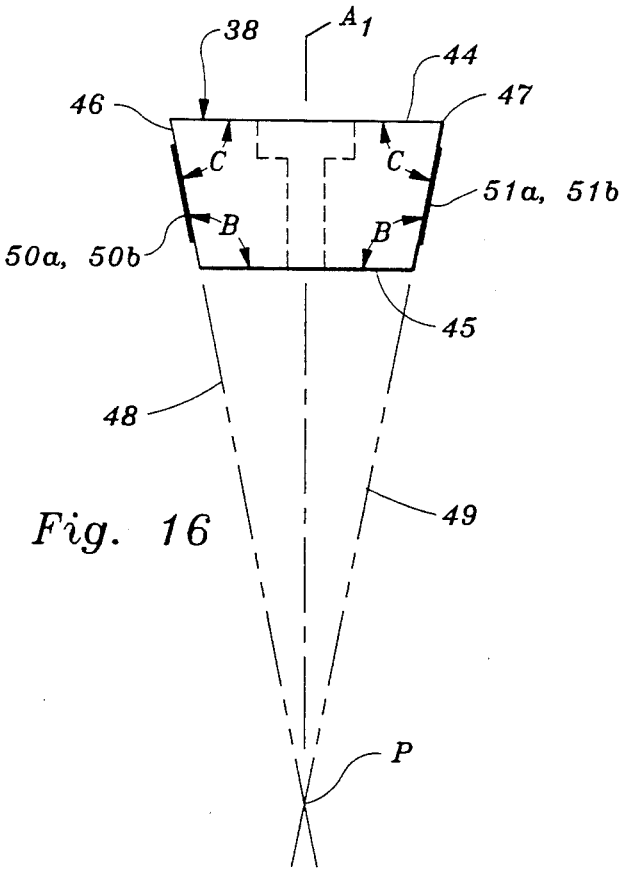
FIGS. 16 and 17 are front elevational and side detail views, respectively, of the wedge block of the biasing means of FIG. 3.
Figure 17:
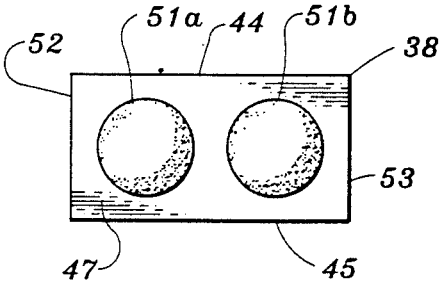

As shown in FIGS. 16 and 17, the non-parallel walls 46, 47 of the wedge block 38 are seen not to intersect the top and bottom surfaces 44, 45 at 90 degrees. Instead, the side surfaces 46, 47 slant whereby the included angle B between the bottom wall 45 and the side walls 46, 47 is greater than 90 degrees while included angle C between the top wall 44 and the side walls 46, 47 is less than 90 degrees. Since such pairs of like included angles are equal to each other, i.e., angle B=angle B and angle C=angle C, the slanted side walls 46, 47 define planes 48, 49 which intersect the action plane A1—A1 at point P. Also intersecting one or the other of the planes 48, 49 is a series of discs **50*a*, 50*b* and 51*a*, 51*b*. The discs 50*a*, 50*b* and 51*a*, 51*b* are constructed of a low friction material such as Teflon, a trademark of DuPont. The discs 50*a*, 50*b* attach to side wall 46 at a common height relative to bottom wall 45, and the discs, 51*a*, 51*b* attach to side wall 47 at the same common height. Functions of the discs 50*a*, 50*b* and 51*a*, 51*b*: limit the application of squeezing forces over a highly accurate and easily repeatable application area vis-a-vis the push blocks 36, 37 of FIG. 3**.

As shown in FIG. 17, the wedge block 38 also includes front and back walls 52, 53 which are parallel to each other and normal to top and bottom walls 44, 45. Note that the front and back walls 52, 53 are constructed such that they snugly fit within and in contact with the side walls of the central housing 10. Hence movement of the wedge block 38 in the transverse direction as indicated by arrow 54 (FIG. 3) is prevented.

Note that cross sections of the wedge block 38 taken in directions right angles to each other define tetragonals of different classes. The transverse and vertical cross sections, for example, are rectangular, while the longitudinal cross section is rhomboidal.

During adjustment as indicated in FIG. 3, the rod 29 is rotated relative to wedge block 38 which because of its mode of connection via the nut 43, converts rotatory movement into rectilinear travel of the wedge block 38 coincident with the action plane A1—A1. The direction of rectilinear movement is a function of clockwise or counterclock rotation of the rod 29. The wedge block 38 is prevented from rotation due to close proximity to the side walls 21 of the housing 10 (see FIG. 3) in the transverse direction indicated by arrow 54. In the longitudinal direction indicated by arrow 55, the slanting side walls 46, 47 wedge against oppositely slanted back walls 56 of the push blocks 36, 37. As the wedge block 38 is provided with a particular direction of rectilinear movement, say in the direction of arrow 57, such movement is translated in longitudinal movement of the pair of push block 36, 37 thereby increasing the braking load on all sets of members 26, 27. This loading is reflected in increased resistance to rotation of the lateral arms 6.

That is, the force required to rotate each lateral arm 6 is evenly distributed within the member groups 25. After the push blocks 36, 37; member groups 25 and the end blocks 22 of the housing 10 (FIG. 2) become welded together into a single unit, angular movement of the lateral arms 6 (and hence movement of the rotatable members 26 relative to stationary member 27) is directly related to the force needed to rotate one or both of the arms 6 about the axis of symmetry 23.

Figure 4:
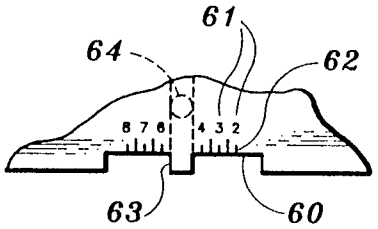
FIG. 4 is a detail side view of a portion of the central housing of FIGS. 1-3 in the vicinity of the centrally positioned friction biasing means illustrating how the amount of friction force being applied to the crank arms is indicated to the user.

Furthermore, if one of the side walls 21 of the housing 10 is provided with a slot 60 (see FIG. 4) in the vicinity of the wedge block 38, the rectilinear movement of the block 38 can be indicated as an indicator of magnitude of resistance loading of the friction braking means 9. In order to aid in the indication process as shown in FIG. 4, resistance loading indicia 61 are marked on an exteriorly viewable scale 62 adjacent to the slot 60. A pointer 63 is pivotally attached to the wedge block 38 and includes a central pivot pin 64 adjacent to the slot 60 wherein angular movement of the pointer 63 relative to the scale 62 indicates brake loading of the friction braking means 9.

Figure 6:
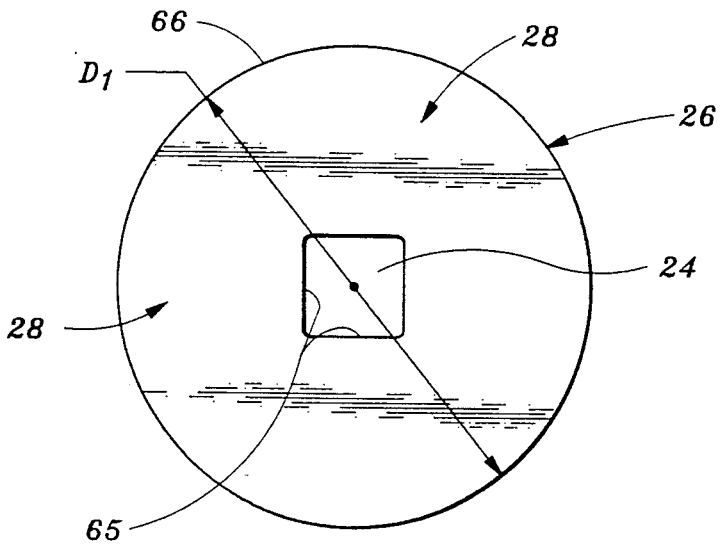
FIGS. 6 and 7 are front elevational and side detail views, respectively, of a rotatable member of each braking means of FIG. 3.
Figure 7:
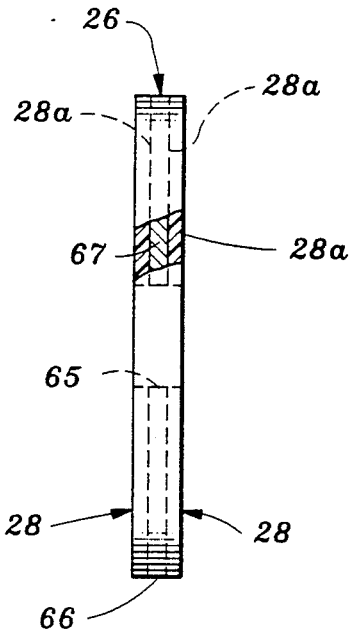

FIGS. 6 and 7 are front elevational and side detail views, respectively, of a rotatable member 26 of FIG. 3 showing the latter in more detail.

As shown, the rotatable member 26 has the central opening 24 previously mentioned in regard to FIG. 5. It is of square cross section to snugly fit over and attach to the arm 6 of FIG. 3. Such opening 24 is defined by a side wall 65. At the circumferential outer surface of side wall 65 is circumferential surface 66; but note that the side wall 65 in constructed in three plys, viz., a metallic central support 67 sandwiched between disc members 28*a*. The latter provide the transversely extending broad surfaces 28 for the rotatable member 26 for functioning in the manner previously described. While the central support 67 is preferably constructed of steel, the disc members 28*a* are preferably constructed of a plastic material such as Teflon, a trademark of DuPont Company, such disc members 28*a* contributing to the smooth braking resistance to rotation previously mentioned. Note the transverse position of the broad surfaces 28: extending from opening 24 to the circumferential surface 66. Also as previously mentioned, the opening 24 is sized to fit at the exterior surface of the lateral arm 6 of FIG. 5 so that action is in concert. The diameter D1 defined by circumferential surface 66 is less that the distance between opposed side walls of the central housing 10 so that as rotation of the former occurs, interference with the latter cannot occur, see FIG. 5.

Figure 8:
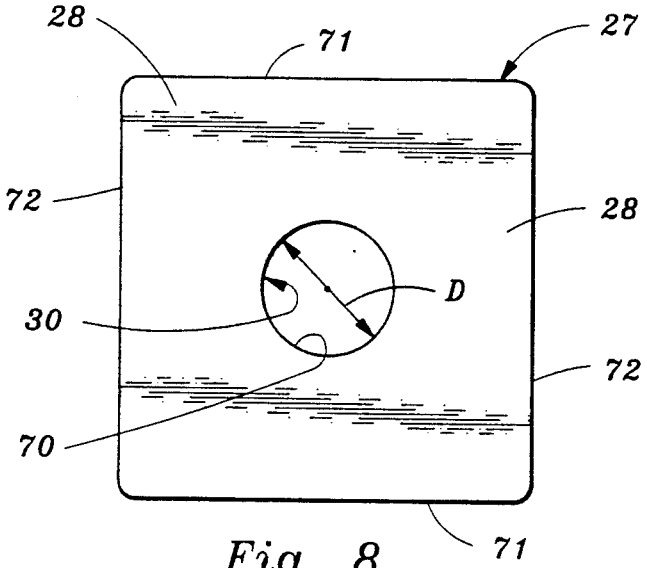
FIGS. 8 and 9 are front elevational and side detail views, respectively, of a stationary member of each braking means of FIG. 3.
Figure 9:
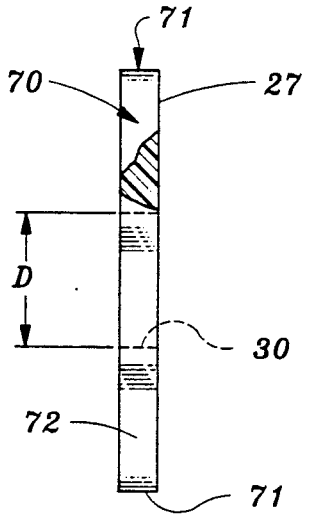

FIGS. 8 and 9 are front elevational and side detail views, respectively, of a stationary member 27 of FIG. 3.

As shown, the stationary member 27 includes the broad surfaces 28 previously mentioned, placed in contact with like surfaces of the rotatable member 26 (viz., into contact with Teflon discs 28*a* of FIG. 7). The result is an unexpected effect by which braking resistance can be generated between these members. In this regard, the stationary member 27 is constructed in a single ply of material such as polypropylene, (see FIG. 9). While any plastic material may be employed, it has been found that the most advantageous is polypropylene because the latter provides excellent braking resistance, and at the same time the polypropylene does not fuse under lateral pressure with the Teflon discs 28*a* of the rotatory member 26.

The stationary member 27 includes a side wall 70 and interior opening 30 of circular cross section of diameter D. The significance of the diameter D as occurring with reference to FIGS. 3 and 5, has been previously discussed.

In the radial direction from the opening 30, the side wall 70 has outer termini. These outer termini are seen to include separate horizontal surfaces 71 at right angles to vertical surfaces 72. The surfaces 71, 72 define a square transverse cross section for the side wall 70. At right angles to the surfaces 71, 72 are the broad surfaces 28 by which braking resistance to rotation is obtained as previously explained.

Note the position of the broad surfaces 28: between the opening 30 and the terminating surfaces 71, 72. Also as previously mentioned, the opening 30 is sized to clear rotation of lateral arm 6 about the axis of symmetry 23 of FIG. 5.

Figure 10:
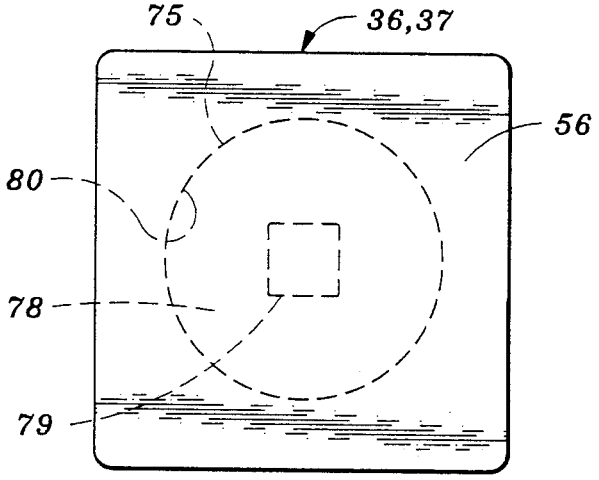
FIGS. 10 and 11 are front elevational and detail side views, respectively, of one of the pair of push blocks of FIG. 3.
Figure 11:
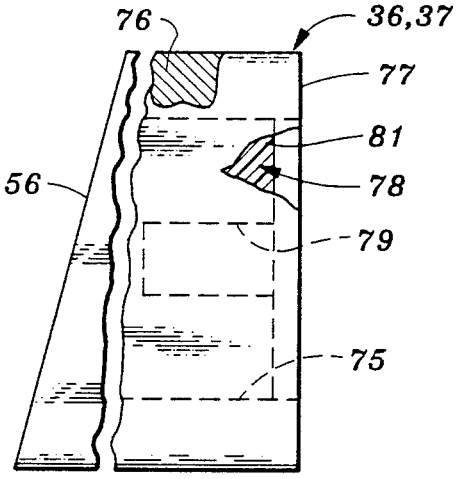

FIGS. 10 and 11 are front elevational and side detail views, respectively, of push blocks 36, 37 of FIG. 3.

As shown, each push block 36, 37 includes the slanted end surface 56 opposite in slant to the surfaces 46, 47 of the wedge block 38 (FIG. 3) previously mentioned. Each push block 36, 37 includes a central cavity 75 of circular cross section that terminates adjacent to its slanted end surface 56. The central cavity 75 defines a side lip 76 having terminating lateral cavity 75 defines a side lip 78 having a terminating lateral surface 77 that is placed in contact with the broad surface 28 (see FIG. 3) of the adjacently positioned stationary member 27. Within the central cavity 75 is positioned a bushing 78 of pliant material. As shown best in FIG. 10, the bushing 78 includes a central opening 79 of square cross section and a circumferential edge 80. Within the central opening 79 of the bushing 77 the lateral arm 6 of FIG. 3 can be journaled. With rotation of the latter, such pliant bushing 78 also rotates about the axis of symmetry of the central housing 10 as previously mentioned, while the push block 36 or 37 remains stationary. The pliant bushing 78 is also provided with annular side wall 81 to more easily accommodate such rotation without bushing breakdown. The bushing 78 is preferably formed of a material of low frictional coefficient. In this regard, any low frictional material may be employed, but the most advantageous has been found to be plastic because the latter provides excellent lubricating characteristics and at the same time the plastic does not fuse together under pressure.

Figure 12:
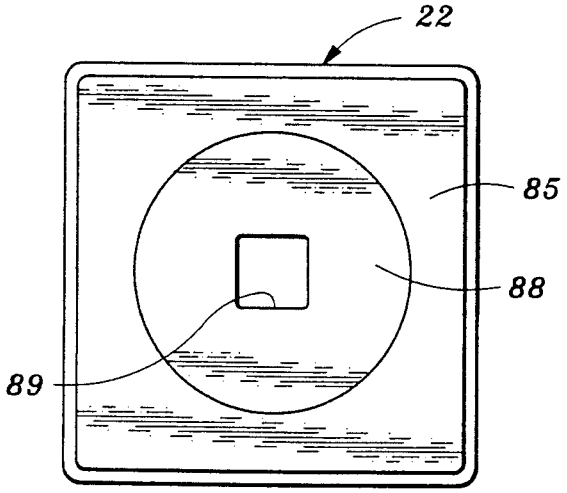
FIGS. 12 and 13 are front elevational and detail side views, respectively, of an end block of the housing of FIG. 3.
Figure 13:
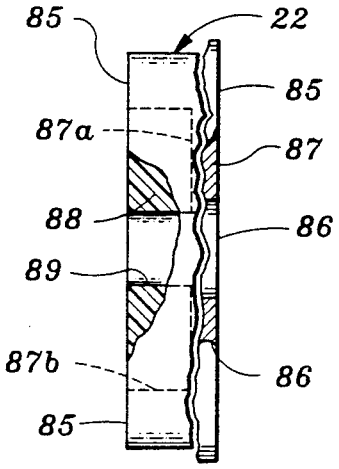

FIGS. 12 and 13 are front elevational and side detail views, respectively, of end blocks 22 of FIG. 3.

As shown, each block 22 includes first and second broad surface 85. After assembly, one such broad surface 85 is placed in contact with the surfaces 28 of a stationary member 27 as previously explained. Each end block 22 has an interior opening 86 of circular cross section defining a side wall 87 that is enlarged at shoulder 87*a* to define a larger cavity 87*b* into which a pliant bushing 88 is inserted. The pliant bushing 88 is provided with an opening 89 that is square in cross section into which the lateral arm 6 of FIG. 3 can be journaled. With rotation of the latter, such pliant bushing 89 also rotates, while the end block 22 remains stationary. The pliant bushing 89 is formed of a material of low frictional coefficient. In this regard, any, low frictional material may be employed, but the most advantageous has been found to be plastic because the latter provides excellent lubricating characteristics and at the same time the plastic does not fuse under pressure.

Figure 14:
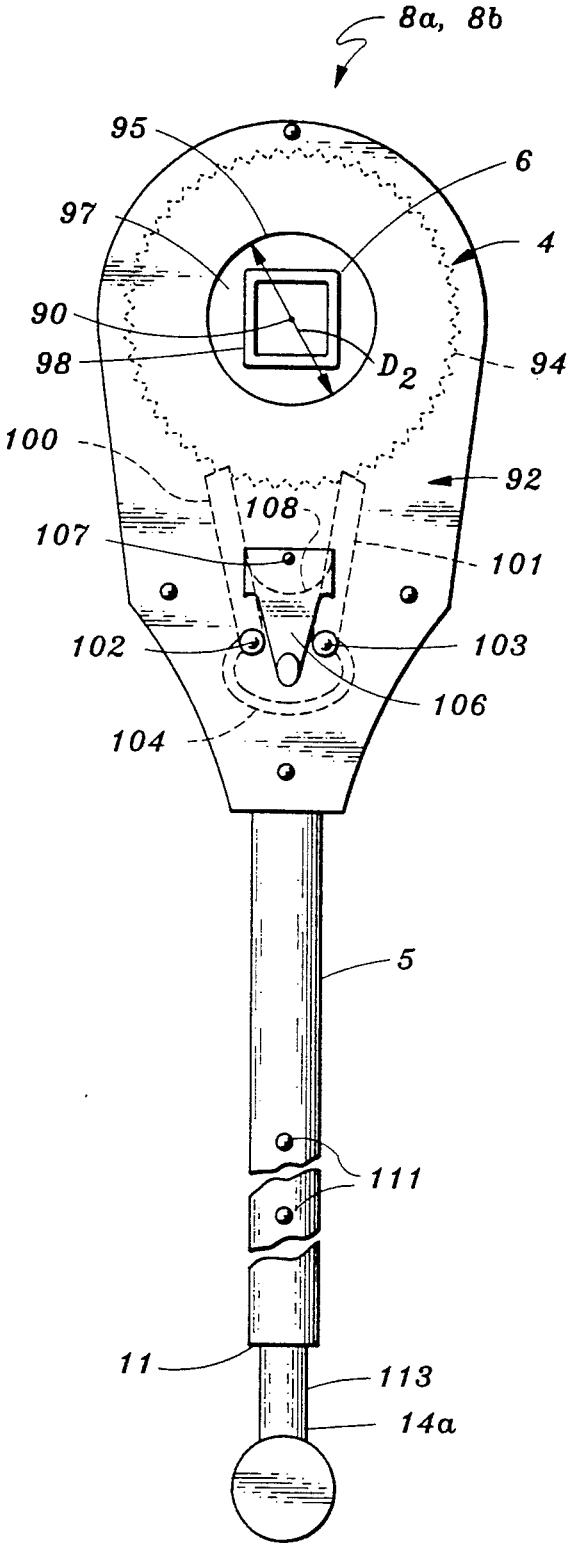
FIGS. 14 and 15 are front elevational and side detail views, respectively, of each crank arm including ratcheting means therefor.
Figure 15:
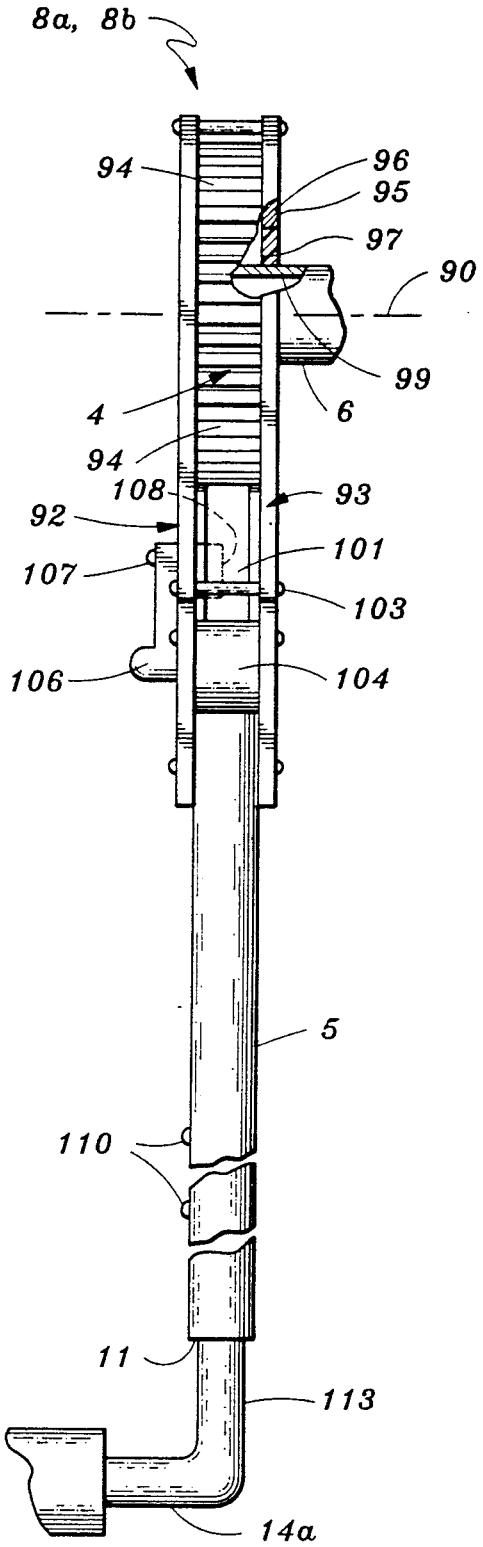

FIGS. 14 and 15 are front elevational and side detail views, respectively, of a crank 8*a* or 8*b* in combination with the ratchet mechanism 4 of FIGS. 1–3.

Each crank 8*a*, 8*b* is L-shaped and comprises forearm 5 and a lateral arm 6, the forearm 5 and lateral arm 6 being interconnected via the rachet mechanism 4. The forearm 5 includes an end 11 remote from the central housing 10 that is connectable to one of a series of action arms—separately—such as a L-shaped arm-handle 14*a* used for arm lifts, arms curls and arm stretches that can be operated over limited arcuate ranges, say 90 degrees to full 360 degrees rotation.

Each lateral arm 6 defines an axis of symmetry 90 coincident with the axis of symmetry of the housing 10 which permits the ratchet 4 including the forearm 5 and arm-handle 14*a* to rotate about axis 90 in limited or full 360 degree rotation. In this regard, the ratchet 4 is provided with a pair of tear-drop shaped plates 92, 93 sandwiching a central gear 94. Each plate 92, 93 is provided with a central opening 95 of diameter D2 defining a side wall 96 into which a pliant bushing 97 is inserted. The pliant bushing 97 is also provided with an opening 98 that is square in cross section matched in shape and dimensions to those of lateral arm 6 so as to fixedly receive same. The gear 94 is also provided with an opening 99 that is square in cross section also matched in shape and dimensions to those of the lateral arm 6. But note that when the plates 92, 93 are rotated by forearm 5, each pliant bushing 97 of each plate 92, 93 also rotates about the axis 90, while the lateral arm 6 remains stationary assuming the gear 94 is not ratchetly engaged. But when the gear 94 is ratchetly attached to the plates 92, 93 via engagement of pawls 100 and 101 with the gear 94, rotation of the plates 92, 93 and gear 94 cause rotation of the lateral arm 6. Note in FIG. 14 that the pawls 100, 101 are rotatable about pins 102, 103 but are kept in contact with the gear 94 via C-shaped spring 104. In order to dislodge one or other of the pawls 100, 101 from contact with the gear 84, the ratchet 4 of the invention is provided with a release trigger 106 pivotable about pin 107 to bring cam surface 108 thereof into contact with such pawl 100, 101. Thus with the release trigger 106 in the mid-position, the lateral arm 6 is rotated in concert with either clockwise or counter-clockwise movement of the forearm 5 so that the invention provides a super-set function of exercise. But if the release trigger 106 is rotated clockwise in FIG. 14, the cam 108 releases pawl 100 from the gear 94. Hence counter-clockwise rotation of forearm 5 and arm-handle 14*a* causes rotation of the lateral arm 6 but the arm 6 is stationary when the forearm 5 is rotated in clockwise direction in FIG. 14, the pawl 101 sliding over the gear 94. And if the release trigger 106 is rotated counter-clockwise in FIG. 14, the cam 108 releases pawl 101 from the gear 94. Hence clockwise rotation of forearm 5 and arm handle 14*a* causes rotation of the lateral arm 6 but the arm 6 is stationary when the forearm 5 is rotated in counter-clockwise direction in FIG. 14, the pawl 100 sliding over the gear 94.

The pliant bushing 97 is formed of a material of low frictional coefficient. In this regard, any low frictional material may be employed, but the most advantageous has been found to be plastic because the latter provides excellent lubricating characteristics and at the same time the plastic does not fuse under pressure.

Thus, the ratchet mechanism 4 of the invention permits the forearm 5 and arm-handle 14*a* to be operationally attached to the lateral arm 6 in a variety of operational modes, say both rotary directions about axis 90, in a clockwise direction only or in a counter-clockwise direction only.

The above description contains several specific embodiments of the invention. It is not intended that such be construed as limitations on the scope of the invention, but merely as examples of preferred embodiments. Persons skilled in the art can envision other obvious possible variations within the scope of the description. For example, various handle configurations can also be attached to the forearm 5 (via spring-driven pins 110 of FIGS. 14 and 15 that penetrate openings 111 after the handle 113 has been inserted interior of the forearm 5). Such operations permit the user to perform various pushing, pulling exercising for strengthening the arms, shoulders, back, legs, and other parts of the body, particularly for professional athletes including weight lifters, body builders, football, baseball and basketball players, golfers, and race car drivers. Hence the scope of the invention is to be determined by the appended claims and their legal equivalents.

What is claimed is:

1. An exerciser which can be readily initialized for use while at the same time generate a large, distributed resistance load in which a user's limbs can be worked in both push-pull, pull only or push only directions, comprising a central, fixed housing having an axis of symmetry and a plane of action normal to said axis of symmetry, first and second cranks each having a lateral arm insertable within said fixed housing from opposite directions and having an axis of rotation coincident with said axis of symmetry for providing clockwise and counterclockwise rotation about said axis of symmetry, said cranks each having a forearm normal to said lateral arm and attached thereto through a ratchet mechanism, first and second independently operatable friction brakes each journaled to said each lateral arm of said first and second cranks wherein said each brake and lateral arm operate in concert, said each brake including a centrally positioned push block and a series of stackable, laterally slidable rotatable and stationary members in edge relationship relative to said axis of symmetry and in broad surface contact with each other, said rotatable and stationary members being distributed over a finite length of said lateral arm of each first and second cranks, a centrally positioned frictional biasing means in biasing contact with said push block of said each of said first and second friction brakes, said friction biasing means including centrally positioned wedge block having slanted side surfaces in operational contact with said push blocks of said brakes and an activation rod in operative contact with said wedge block for providing transverse movement to said wedge block relative to said housing, said transverse movement being converted into bi-directional longitudinal travel of said push blocks thereby generating bi-directional biasing squeezing pressure to said series of rotatable and stationary members of friction brakes whereby independent resistance to rotation of said lateral arm about said axis of symmetry is smooth over a full 360 degrees of rotation of either said first or second cranks individually or in tandem.

2. The exerciser of claim 1 in which said broad surface contact of said stackable, laterally slidable rotatable and stationary members of said each first and second friction brakes is along parallel contact planes that are substantially normal to said axis of symmetry and substantially parallel to said plane of action of said housing, said rotatable and stationary members of each of said first and second friction brakes being subdivided into a plurality of rotatable and stationary members to generate a large resistance loading for said first and second brakes.

3. The exerciser of claim 2 in which said plurality of rotatable and stationary members is in a range from 12 to 20.

4. The exerciser of claim 2 in which said plurality of rotatable and stationary members is in a range from 14 to 18.

5. The exerciser of claim 1 in which each of said lateral arms of said first and second cranks is square in cross section.

6. The exerciser of claim 1 in which said ratchet mechanism of each of said first and second cranks comprises an independently rotatable gear journaled to said lateral arm of each of said first and second cranks, a pair of tear-drop shaped plates contacting said gear and attachable thereto via a pair of retractable pawls and a trigger for individually activating said pawls, each of said plates including a bushing capable of providing rotation independent of said gear in accordance with activation state of said trigger.

7. The exerciser of claim 1 in which said housing is square in cross section, to snugly receive similarly sectioned stationary members of said first and second friction brakes so as to prevent rotation thereof relative to said axis of symmetry of said housing, said housing also including end blocks of square cross section penetrated by said axis of symmetry of said housing.

8. The exerciser of claim 7 in which said stationary members of square cross section includes a central plate, first and second layers contacting said central plate, said central plate and first and second layers having coextensive and aligned openings of circular cross section and of sufficient diametrical length so as not to interfere with operation of said lateral arm penetrating therethrough.

9. The exerciser of claim 8 in which first and second layers are constructed of polypropylene.

10. The exerciser of claim 1 in which said lateral arms of said first and second cranks are of a square cross section and in which each of said rotatable members of said first and second friction brakes is circular in cross section and include a central opening of square cross section penetrated by and operationally attached to said lateral arm of each first and second cranks.

11. The exerciser of claim 1 in which said push blocks are of square cross section and each includes an oppositely slanted end surface in sliding contact with said wedge block, a central opening of circular cross section and a bushing of pliant material at its central opening rotatably attached therewith, said bushing including an opening of square cross section in contact with said each lateral arm of said each first and second cranks penetrating therethrough wherein rotation of said lateral arm about said axis of symmetry of said housing causes like rotation of said bushing relative to said push block.

12. The exerciser of claim 7 in which said end blocks each includes a central opening of circular cross section and a bushing of pliant material at its central opening rotatably attached therewith, said bushing including an opening of square cross section in contact with said each lateral arm of said each first and second cranks penetrating therethrough wherein rotation of said lateral arm about said axis of symmetry of said housing causes like rotation of said bushing relative to said end block.

13. The exerciser of claim 1 in which said activation rod is coincident with and bisected by said action plane and includes a handle for rotating said rod about an axis normal to said axis of rotation of said lateral arms, said wedge block including a nut fixedly attached to said wedge block and threadably attached to said rod wherein rotation of said rod is converted into rectilinear travel of said wedge block along an axis coincident with said action plane and normal to said axis of rotation of said lateral arms of said cranks.

14. The exerciser of claim 13 in which said housing is provided with side and end walls and a slot is provided in one of said side walls in operative contact with said wedge block wherein position of said wedge block relative to a scale adjacent said slot is used as an indicator of magnitude of resistance loading of said first and second friction brakes.

15. An exerciser for providing resistance loads over a full 360 degree arc in a smooth manner for a user's limbs, comprising a central, fixed housing having an axis of symmetry and a plane of action normal to said axis of symmetry that intersects at least a portion of said user's body, first and second cranks manipulated by said user's limbs for rotation about said axis of symmetry of said housing, each of said cranks having a lateral arm insertable within said fixed housing from opposite directions, a forearm normal to said lateral arm and a ratcheting mechanism connecting said forearm to said lateral arm, first and second independently operatable friction brakes each journaled to said each lateral arm of said first and second cranks interior of said housing and including a series of edge-stackable rotatable and stationary members squeezable together along broad surfaces in a manner that resists rotation of said lateral arms of said first and second cranks at essentially a constant magnitude of frictional pressure even though said cranks operate independently, centrally positioned frictional biasing means in biasing contact with said push block of said each of said first and second friction brakes, said friction biasing means including centrally positioned wedge block having slanted side surfaces in operational contact with said push blocks of said brakes and an activation rod in operative contact with said wedge block for providing transverse movement to said wedge block relative to said housing, said transverse movement being converied into bi-directional longitudinal travel of said push blocks thereby generating bi-directional biasing squeezing pressure to said series of rotatable and stationary members of friction brakes whereby independent resistance to rotation of said lateral arm about said axis of symmetry is smooth over a full 360 degrees of rotation of either said first or second cranks individually or in tandem.

16. The exerciser of claim 15 in which each lateral arm of said first and second cranks is square in cross section.

17. The exerciser of claim 15 in which said each ratchet mechanism of said first and second cranks comprises an independently rotatable gear journaled to said lateral arm a pair of tear-drop shaped plates contacting said gear and attachable thereto via a pair of retractable pawls, a trigger attached to said plates for independently activating pawls, each of said plates including a bushing capable of providing rotation independent of said gear.

18. The exerciser of claim 16 in which said stationary members of square cross section includes a central plate, first and second layers sandwiched about said plate, said central plate and first and second layers having coextensive and aligned openings of circular cross section and of sufficient diametrical length so as to not interfere with operation of said lateral arm penetrating therethrough.

19. The exerciser of claim 15 in which said first and second friction brakes also includes first and second push blocks of square cross section each having an oppositely slanted end surface in sliding contact with said wedge block, a central opening of circular cross section and a bushing of pliant material at its central, opening rotatably attached therewith, said bushing including an opening of square cross section in contact with said each lateral arm of said each first and second cranks penetrating therethrough wherein rotation of said lateral arm about said axis of symmetry of said housing causes like rotation of said bushing relative to said push block.

20. The exerciser of claim 19 in which said activation rod is coincident with and bisected by said action plane and includes a handle for rotating said rod about an axis normal to said axis of rotation of said lateral arms, said wedge block including a nut fixedly attached to said wedge block and threadably attached to said rod wherein rotation of said rod is converted into rectilinear travel of said wedge block along an axis normal to said axis of rotation of said lateral arms of said cranks.

* * * * *